US005100352A

United States Patent [19]

Dunstan

[11] Patent Number: 5,100,352

[45] Date of Patent: Mar. 31, 1992

[54] APPARATUS FOR THE PROPULSION OF BOATS

[76] Inventor: Harry I. Dunstan, "Trevona", Cliff Road, Mevagissey, Cornwall PL26 6QW, England

[21] Appl. No.: 604,129

[22] Filed: Oct. 29, 1990

[30] Foreign Application Priority Data

Feb. 10, 1990 [GB] United Kingdom ..... 9003049

[51] Int. Cl.[5] ..... B63H 16/12

[52] U.S. Cl. ..... 440/102

[58] Field of Search ..... 440/102, 103, 104, 101, 440/105, 106, 107, 108; 416/74, 79, 80, 81, 82, 83

[56] References Cited

U.S. PATENT DOCUMENTS

| | | | |
|---|---|---|---|
| 717,980 | 1/1903 | Flint | 440/102 |
| 982,202 | 1/1911 | Doan | 440/103 |
| 1,381,923 | 6/1921 | Kemp | 440/105 |
| 1,476,987 | 12/1923 | Larsen | 440/102 |
| 1,495,628 | 5/1924 | Adelman | 440/103 |
| 1,624,743 | 4/1927 | Kimberlin | 440/102 |
| 2,000,630 | 5/1935 | Williams | 440/102 |
| 3,729,369 | 4/1973 | Trull | 440/102 |
| 3,884,175 | 5/1975 | Bellis | 440/103 |

FOREIGN PATENT DOCUMENTS

| | | |
|---|---|---|
| 283411 | 1/1928 | United Kingdom . |
| 319059 | 9/1929 | United Kingdom . |
| 342445 | 2/1931 | United Kingdom . |
| 1426652 | 3/1976 | United Kingdom . |
| 2056930 | 3/1981 | United Kingdom . |
| 2213119 | 8/1989 | United Kingdom . |

*Primary Examiner*—Jesus D. Sotelo
*Assistant Examiner*—Stephen P. Avila

[57] ABSTRACT

A front-facing rowing arrangement for a boat includes a pair of oars of which includes a handle 1 and a blade 3 mounted for pivotal movement about spaced parallel axes on a supporting member 5 which is itself hingedly mounted for movement about a horizontal axis extending parallel to the direction of travel of the boat. The handle 1 and blade 3 of each oar are connected by a lever/linkage system which is such that the angular velocity of the blade relative to the angular velocity of the handle increases steadily throughout a typical power stroke.

10 Claims, 6 Drawing Sheets

Fig 4
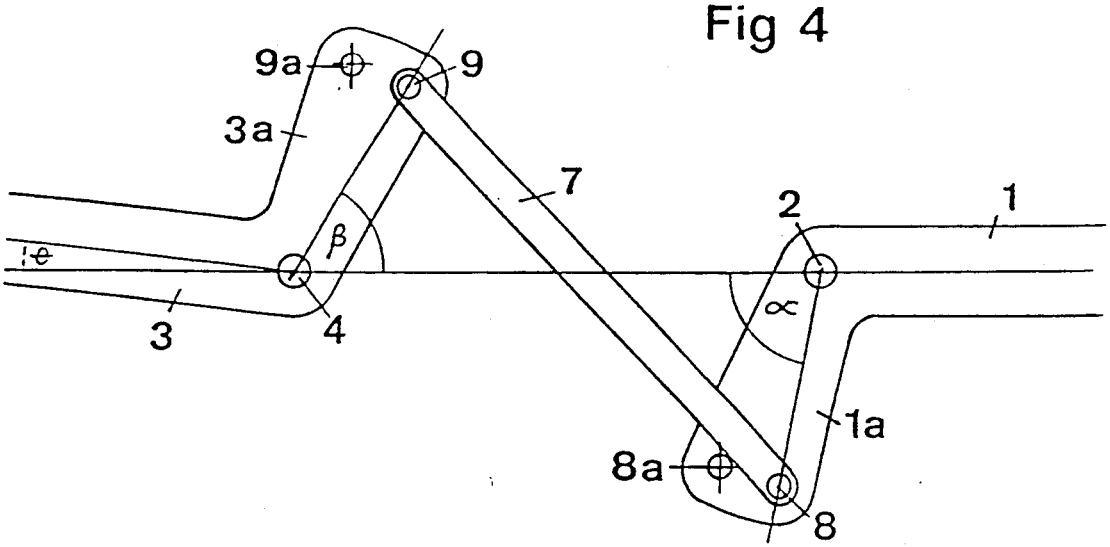
Fig 5
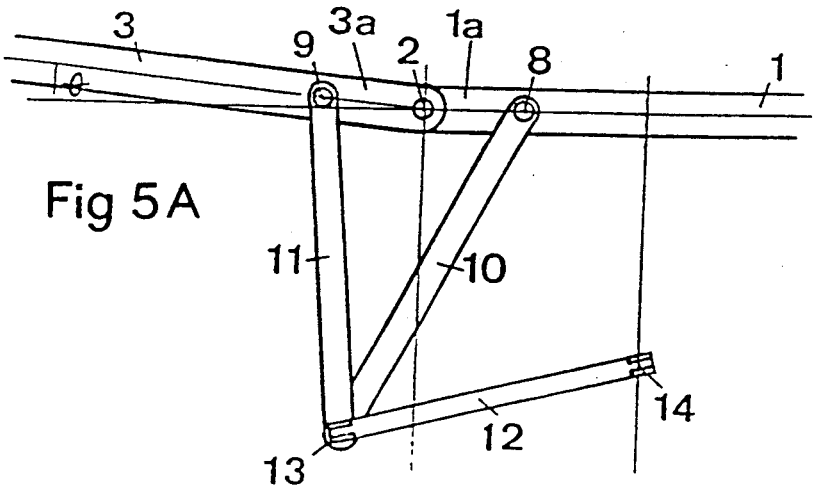
Fig 5A
Fig 5B
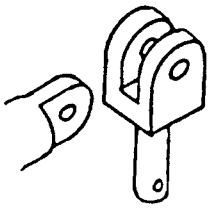

1
1a
2
3a
3
6
8
9
10
11
12
13
14
15
16

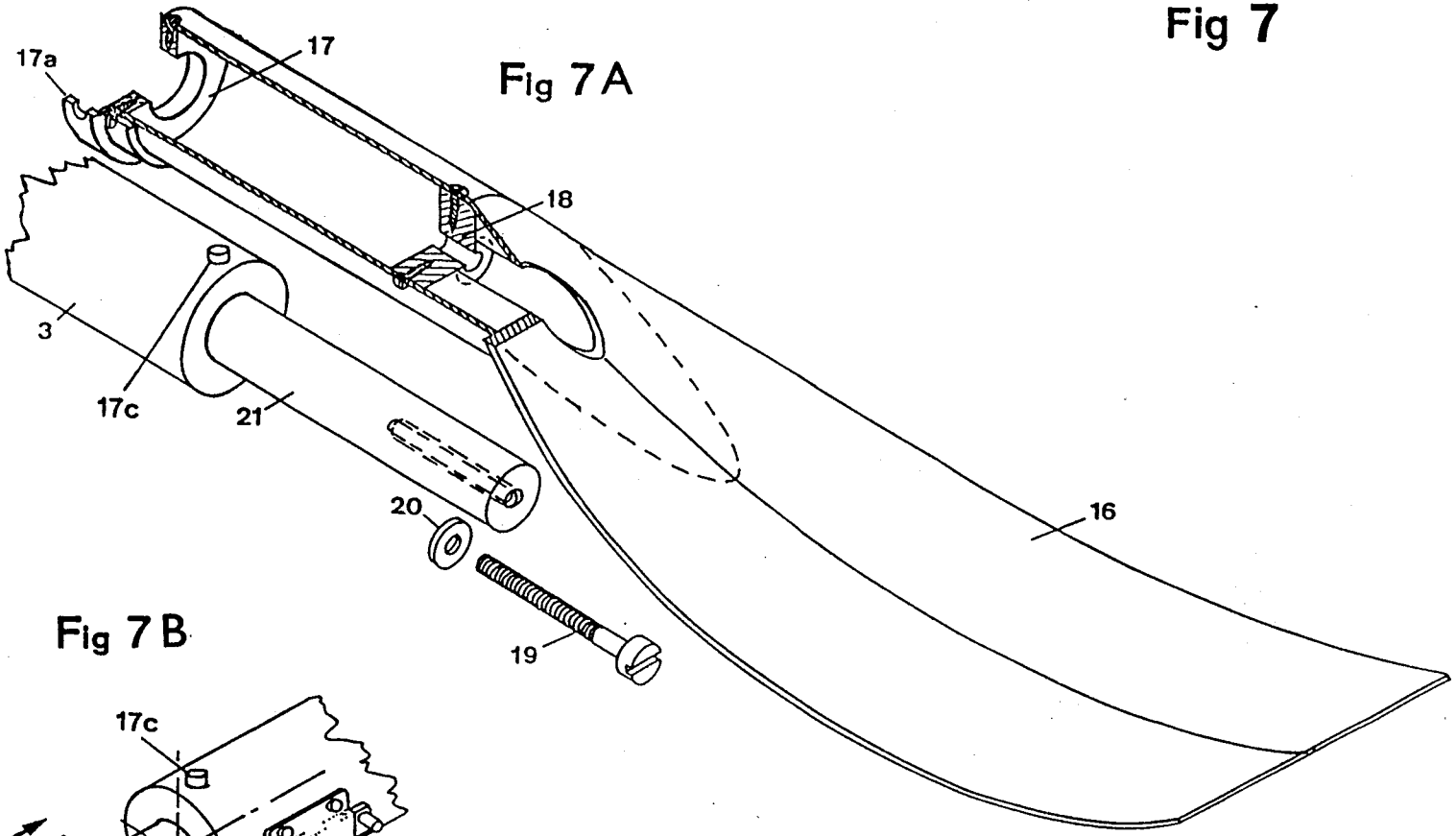
Fig 7
Fig 7A
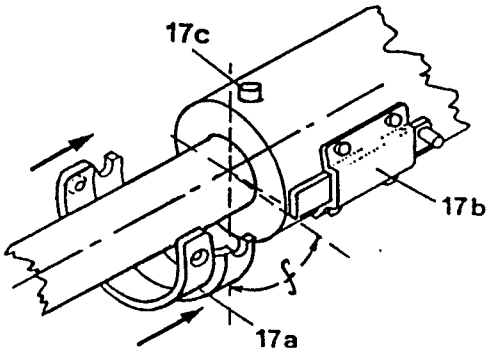
Fig 7B

APPARATUS FOR THE PROPULSION OF BOATS

FIELD OF THE INVENTION

This invention relates to apparatus for the propulsion of boats and is concerned with the provision of a new design of oars for use in rowing facing the direction of travel.

BACKGROUND TO THE INVENTION

As mentioned by Holm in Canadian Patent Specification No. 1172522, there have been many proposals for the provision of forward-facing rowing, the majority of which have been cumbersome, complicated or bizarre. Holm discloses an oar construction which includes overlapping inner and outer components pivotally connected to each other and a pivoting brace acting between a rear support post and the inner end of the outer oar component.

In British Patent Specification No. 342445 (Devienne) there is disclosed an oar arrangement for forward-facing rowing which comprises two coacting and separately pivoted members, one forming the handle and the other carrying a pivoted blade. The handle and blade are interconnected in such way that, when the oar and handle are in line, the maximum relative blade velocity is obtained.

A further oar arrangement permitting forward-facing rowing is described in British Patent Specification No. 2056930A (Witchell). In this arrangement, each oar has an inboard and outboard section the ends of which come together pivotally at a common zone of attachment to the boat and are mechanically interconnected so as to promote an opposite movement of the inboard section to that of the outboard section, the interconnection being in the form of two arms or links each connected to an oar section and themselves coming together at a pivot moving within a fixed channel attached to the gunwhale of the boat.

Although the oar arrangements described in these earlier specifications permit forward-facing rowing, the rowing action is of limited efficiency. Other forward facing rowing arrangements are shown in British Specifications Nos. 283411 (Kruse), 319059 (Baxter), 1426652 (Bosmorin) and 2213119 (Deutschmann), and in U.S. Pat. Nos. 1,381,923 (Kemp) and 3,729,369 (Trull). Trull also discloses an automatic feathering arrangement. A gear arrangement for the provision of forward-facing rowing is shown in U.S. Pat. No. 3,884,175 (Bellis). These other arrangements are also of limited efficiency.

It is accordingly an object of the present invention to provide a forward-facing oar arrangement which is more efficient than previous proposals.

SUMMARY OF THE INVENTION

The invention accordingly provides a forward-facing rowing arrangement which includes an oar handle and an oar blade interconnected by a lever/linkage system which is so arranged that the angular velocity of the blade increases throughout a power stroke when the angular velocity of the handle is maintained at a steady rate.

Various rates of increase for the blade acceleration can be made available, such rates being described herein as acceleration ratios. The acceleration ratio for a given linkage arrangement is the relative velocity at the end of a power stroke compared to the velocity at the start of the power stroke. As there is no generally accepted standard oar stroke, a notional standard is devised herein for making such comparisons.

A handle movement of 60° is chosen as being typical, such a movement beginning at 30° forward of an athwartships position. The movement is divided into six equal increments of 10°, and it is the angular movement of the blade during the first handle increment divided into the angular movement of the blade during the last handle increment which is termed the acceleration ratio.

With the present invention, acceleration ratios from a minimal figure up to 3.0 or more can be arranged, the object being to provide scope for the boat owner not only to face forwards but to maintain a steady pull on the oar handles without accelerating the handles. The magnitude of the acceleration ratio which is chosen will depend upon the strength and physique of the rower, how easily the boat is driven and whether the rower requires a high speed or not.

Thus, the powerful athlete who wants to explore rivers may choose a light, easily driven shell and a high acceleration ratio, while the less active, older person who wishes to photograph wild life would choose a stable craft and a much lower ratio. For each, the end result will be the same in one respect; i.e. the rower will, by trial and error, choose the ratio which enables him or her to row at a chosen speed where no acceleration of oar handles is required.

For a convenient arrangement, which is similar in layout to conventional oars, the oar blade and oar handle are pivotally mounted on a supporting member for pivotal movement relative thereto about axes which are spaced apart in a direction which extends athwartships, i.e. at right angles to the intended direction of travel of the boat, the lever or linkage system being such that the axis of the oar handle extends athwartships at the midpoint of the power stroke.

The athwartship alignment of axes and handle is necessary only if a traditional layout is required. An oar blade can work equally well when sited remotely from the oar handle.

The lever or linkage system interconnecting the oar handle and the oar blade preferably comprises crank arms on the oar handle and on the oar blade, which crank arms are of substantially equal length L and are interconnected by a link the length of which is significantly greater than L, being at most 2.7 L, but which preferably has a length of between 2 L and 2.5 L.

The crank arms for the oar handles or the oar blades may be formed as separate components which can be attached to the oar handles or oar blades respectively in alternative manners such as to permit variation of the crank angles and thus of the acceleration ratio.

The interconnecting link may be adjustable in length, for example, it may include a turnbuckle, the acceleration ratio being increased by reducing the length of the link by means of the turnbuckle. The interconnecting link may be either a straight link or a cranked link, such cranking of the link, if provided, being such as to permit the oar blade to be moved into a position extending alongside the boat without the link coming into contact with the pivot axis for the oar blade.

In order to further increase the efficiency of the rowing action, an automatic feathering action is preferably provided, the feathering action being afforded by supporting the outer end portion of each blade on low-friction bushes, each blade outer end portion having a centre of gravity which is offset from the centre line of the oar such that, when the blade is in the air, it adopts a position generally parallel to the surface of the water whereas, when the blade is immersed in the water during a power stoke, it adopts a perpendicular position with its concave surface towards its line of travel.

Alternatively, the oar blades can be constrained to adopt a perpendicular position only when driving the boat forwards whereas, during the return stroke, the oar blade automatically adopts a position approximately 5° from horizontal and truly planes on the water surface, as will traditional oars when feathered.

BRIEF DESCRIPTION OF THE DRAWINGS

FIG. 4 is a diagrammatic plan view of the blade and handle connection of FIG. 1, FIG. 5 is a diagrammatic plan view of a further form of blade and handle connection, FIG. 7 is an exploded perspective view of an end of an oar illustrating a preferred form of automatic feathering mechanism.

DESCRIPTION OF THE PREFERRED EMBODIMENTS

Figure 1:
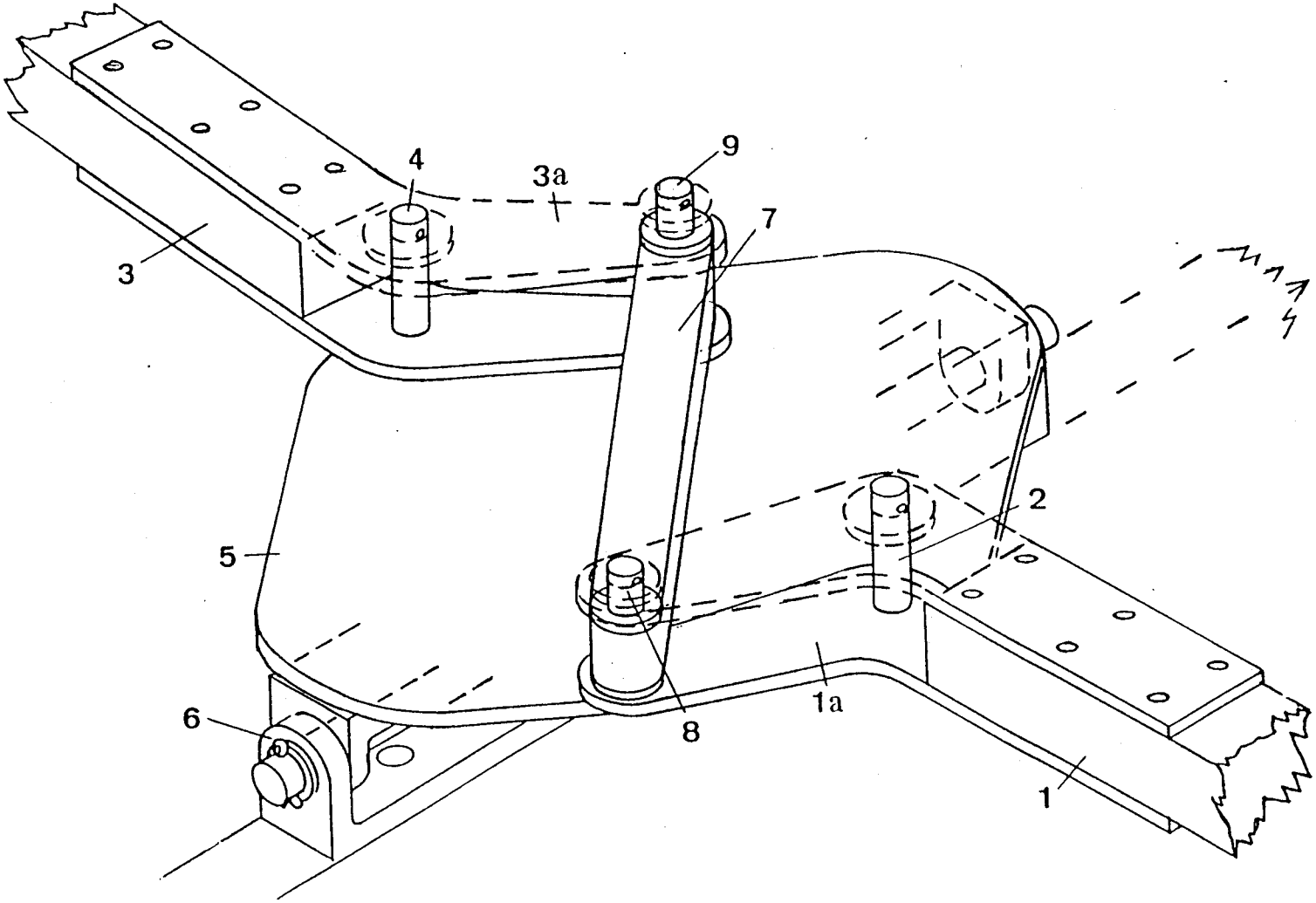
FIG. 1 is an isometric view of a first form of interconnection between an oar handle and an oar blade.

Referring first to FIG. 1, this shows an arrangement which includes an oar handle 1 which is mounted on a pivot pin 2 for rotation of the oar handle 1 about the axis of the pin 2. The oar blade 3 is similarly mounted on a pivot pin 4, with both pivot pins 2 and 4 carried by a plate-like supporting member 5 to which is attached a hinge 6, the hinge 6 including a pair of pivotally connected yokes, one of which is attached to the supporting member 5 and the other of which is secured on or near the gunwhale of the boat with its centre line or hinge axis parallel to the centre line of the boat itself.

Figure 2:
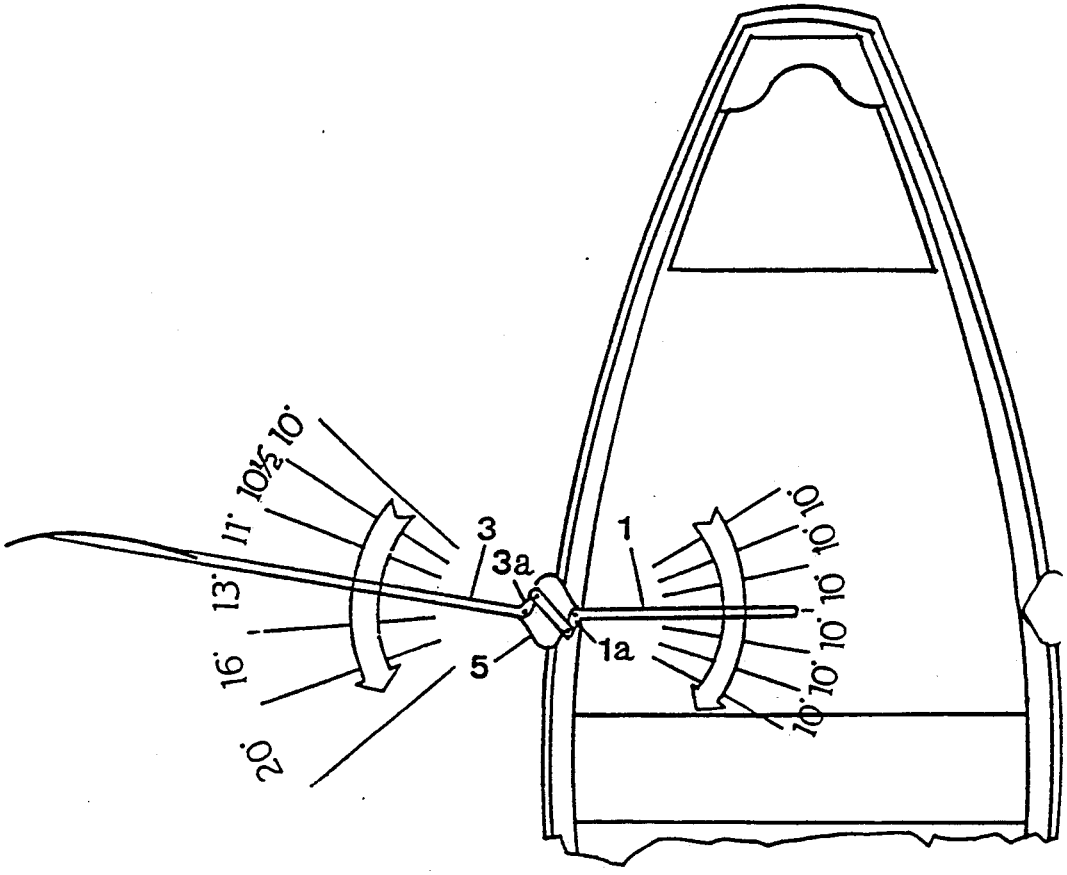
FIG. 2 is a plan view of the arrangement shown in FIG. 1 fitted to a boat.

In an alternative arrangement, which may be adopted when the width of the boat is significantly less than that illustrated in FIG. 2, the hinges 6 are carried by outriggers which extend outwardly of the sides of the boat and are appropriately braced to withstand the torsional loads to which the hinges are subjected during rowing.

When an outrigger arrangement is provided, the two outriggers may be interconnected to form a single structure which can then be built into the shell of the boat, this structure being provided, if desired, complete with the forward-facing oar construction of the invention. In addition, with such structure, a braced support for the pivot axes can be provided with such axes located, if desired, so that they do not project beyond the extremities of the outriggers.

The handle 1 is provided at its inner end with a crank or lever arm 1*a*, and the blade 3 is similarly provided at its inner end with a crank or lever arm 3*a*. As illustrated, each of the two cranks or lever arms 1*a* and 3*a* is fabricated from two plates, the top plate being illustrated in each case in broken lines. The cranks or lever arms 1*a* and 3*a* move between the supporting member 5 and a cover plate, of similar dimensions to the supporting member 5, which is disposed above the supporting member 5 but has been omitted from FIG. 1 for the sake of clarity.

Crank or lever arm 1*a* carries a pivot pin 8, and crank or lever arm 3*a* carries a pivot pin 9, the two pivot pins 8 and 9 being interconnected by a link 7. The lengths of the crank arms or levers 1*a* and 3*a*, i.e. the distances between pins 2 and 8 on the one hand and between pins 4 and 9 on the other hand, are equal or approximately equal, and of a length between approximately 6% of the handle length and approximately 15% of the handle length. The length of the link 7 is between 1 and 2.7 times the length of each crank arm. The preferred length of the link 7 is between 2 and 2.5 times the length of each crank arm. If desired, the link 7 may include a turnbuckle or other form of length adjuster to enable the length of the link 7 to be adjusted between the limits mentioned above. The relative proportions of the components interconnecting the handle 1 and the blade 3 are such as to provide a compact construction while at the same time enabling the components to be of adequate strength to withstand the stresses to which, in use, they are subjected, on the assumption that ordinarily available engineering materials are employed.

The degree of angular movement of the oar blade 3 for a given angular movement of the oar handle 1 is illustrated in FIG. 2, the arrow showing the directions of movement of the handle 1 and the blade 3 during the power or working stroke. As can be seen, the first 10° of movement of the handle 1 results in 10° of movement of the blade 3. For comparative purposes, it is assumed that a typical handle movement is through an arc of 60°, starting from 30° forward of an athwartships position, as mentioned earlier. This arc is divided into six 10° increments and it is the blade's angular movement during the last increment of handle movement divided by the blade's angular movement during the first increment of blade movement which is termed the acceleration ratio. In this example it is 20° divided by 10°=2°.

In a conventional rowing construction, the boat steadily accelerates during the power stroke, and then decelerates while the oars are being returned to start the next power stroke. In order to maintain an effective rowing action, the rower must accelerate his oar during his power stroke but, inevitably, he will relax his pull just before he reaches the end of the power stroke in readiness for withdrawing his oar and effecting the return stroke.

An important advantage of the present invention is thus that, as the relative blade velocity increases during the power stroke, and is at its maximum at the end of the power stroke, the oar blade can be caused to accelerate during the power stroke without a corresponding requirement for acceleration of the oar handle. A much smoother, more efficient rowing action is thus obtained.

The preferred acceleration ratio will depend on the strength or physique of the rower, how easily the boat is driven and the speed required. Thus, an athlete requiring pleasant exercise might choose a light racing shell and a high acceleration ratio whereas, for the very young or elderly rower using a heavier dinghy, a lower acceleration ratio will be more suitable. Both users will have chosen the correct ratio when they do not have to accelerate the oar handles when travelling at the chosen speed.

Figure 3:
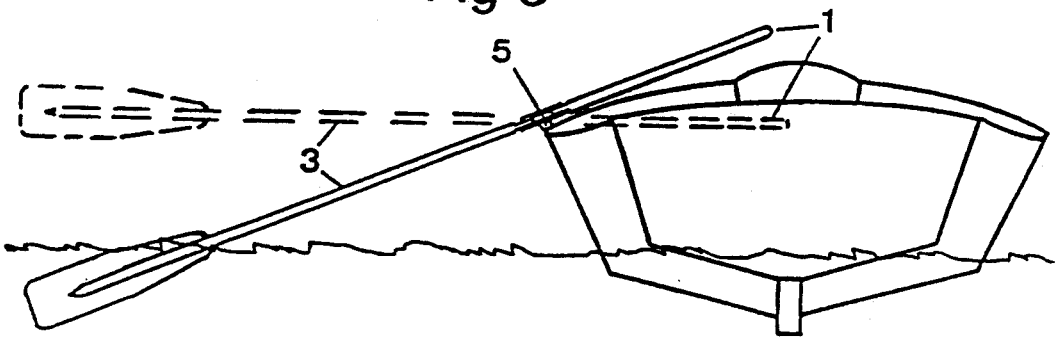
FIG. 3 is an end view of the boat shown in FIG. 2.

As can be seen from FIG. 3, the length of the oar handle is typically one third of the total length of the oar, and the oar is pivotable about the hinge axis between the position shown in full lines, which it occupies during the power stroke, and the position shown in broken lines, into which it is moved for the return stroke.

FIG. 4 illustrates an arrangement which can provide eight different acceleration ratios from a single device. The designer will have chosen cranks with angles $\alpha$ and $\beta$ which will yield the best range of acceleration ratios for his requirement, based upon the principle that "*when one crank is acting upon another of similar length by a connecting link, the angular velocity of the crank which is nearer to being perpendicular to that link will be lower than the other*".

In determining, by experiment, that these cranks will yield the required acceleration ratios, the designer will have selected links of a length to occupy the positions 8a/9, 8/9a and 8a/9a, in the same way that the link 7 occupies the position 8/9. In each case, the angle $\theta$ is calculated to ensure that, for a handle stroke of 60°, the blade 3 begins and ends the power stroke at equal angular spacings from the athwartships condition. Finally, crank 1a may be separated from the handle 1 and used in the place of crank 3a for the blade member 3, and vice versa, requiring up to four different links and, in turn, providing four different acceleration ratios bringing the total to eight.

It will be appreciated from a consideration of FIGS. 1 and 4 that, if a straight link 7 is used as shown, the link 7 will foul the pivot pins if the handle 1 is moved beyond the end of the normal power stroke towards a stowage position in which the blade 3 extends almost in the direction of travel of the boat. If, however, the straight link 7 is replaced by an appropriately shaped, cranked or curved link, provision can be made enabling the blade 3 to be moved into a stowed position. With this arrangement, in order to assist in maintenance of the oar blades in the stowed or parked position, a cord may be provided for linking together the two oar blades.

Figures 6, 6A, 6B:
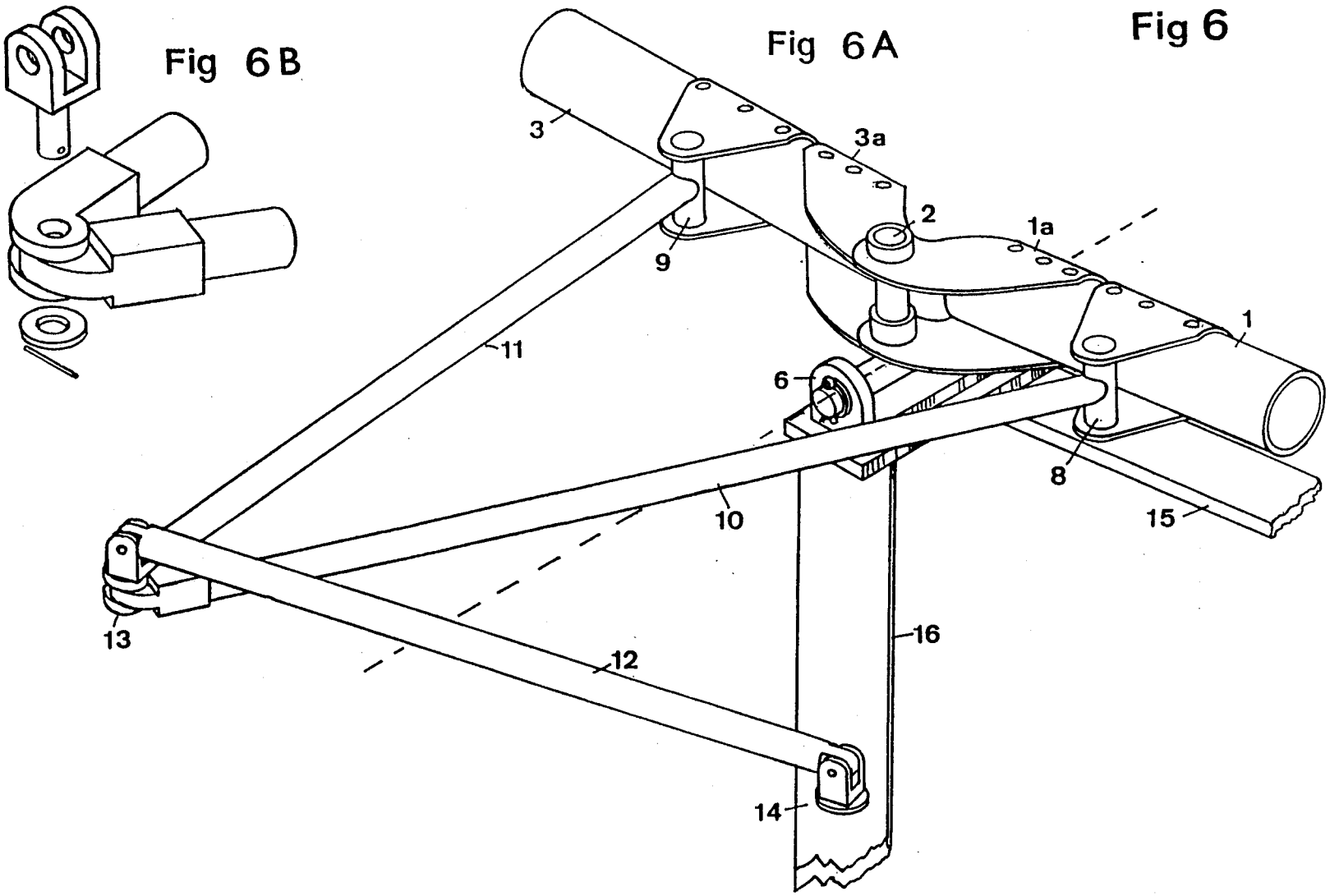
FIG. 6 is an isometric view of the blade and handle connection of FIG. 5, including a detail to an enlarged scale of a joint between the links.

An alternative form of interconnection between an oar handle 1 and an oar blade 3 is shown in FIGS. 5 and 6 to which reference should now be made. This embodiment is less compact than the embodiment of FIGS. 1 to 4 but can be produced from relatively light-weight components. An inner end portion of the handle 1 performs the function of the crank arm or lever 1a while an inner end portion of the blade 3 performs the function of the crank arm or lever 3a. The handle 1 and blade 3 have a common pivot mounting on a pin 2 carried by the hinge mechanism 6 so that there is no torque applied to the hinge.

During a power stroke, a primary link 10 is in compression and acts upon a secondary link 11 which is in tension. A swivel joint 13 (which is shown to an enlarged scale in the insert to FIG. 6) connects the primary and secondary links 10 and 11 and is forced to travel in a roughly fore and aft line by a third or restraining link 12 whose inboard end is attached to a swivel 14 on the craft itself, or on a part of the rigger 15/16.

The lengths of the handle and blade portions 1a and 3a should be limited to about 25% of the length of the handle with the links 10 and 11 both having a length about 50% of the handle length. The link 12 can be of any suitable length provided that it does not impede movement of the rower. With a device having the relative proportions illustrated in FIG. 5, the resulting acceleration ratio is 1.88.

As shown, link 11 in FIG. 5 has a length which is 91% of the length of the link 10. If the length of link 10 is maintained constant and the length of link 11 is reduced to 84% of the length of link 10 (with corresponding adjustment of the length of link 12), then the acceleration ratio is increased to 2.43. If the length of link 11 is further reduced to 77% of that of link 10, the acceleration ratio is increased to 3.60. Intermediate adjustments of the length of link 11 will, of course, result in corresponding intermediate adjustment of the acceleration ratio.

Turning next to FIG. 7, this shows the manner whereby automatic feathering can be afforded. The outer end portion 16 of the oar blade 3 includes a curvate portion of conventional form and a cylindrical sleeve portion within which a pair of spaced low friction bearing bushes 17 and 18 are located. The two bushes 17 and 18 are of polytetrafluoroethylene or of some other low friction plastics material whereas the other oar blade components are of anodised aluminium, or other material which is suitable for marine applications.

The stem of the oar blade 3 terminates in a shaft 21 which fits within the sleeve of the blade end portion 16 so as to be supported by the first bearing bush 17, the shaft 21 being held in position within the sleeve by means of a stainless steel pin 19. A stainless steel washer 20 is located between the head of the pin 19 and bearing bush 18 which supports an unthreaded portion of the stem of the pin 19. After assembly, the hole in the blade over the head of the pin 19 may be closed by means of a removable plug (not shown).

The curvate portion of the blade end portion 16 has a centre of gravity which is offset from the centre line of the oar. The easy sliding fits between the bush 17 and the shaft 21, and between the threaded pin 19 and the bush 18, thus ensure that, in still air, the blade end portion 16 adopts the feathered position in which it extends generally parallel to the surface of the water.

When, however, the blade end portion is immersed in the water, as it is during the power stroke, any movement of the blade results in it adopting a position perpendicular to its line of travel. Any tendency for the blade to turn past a perpendicular position, through, for example, only partially immersing the blade, is counteracted by one of two hook-stops located one at each end of a half collar 17a which revolves with the blade portion 16. Whether rowing forwards or reversing, one of these hook-stops on collar 17a will come into contact with a button-stop 17c located on the stem of the oar blade 3. If, because of gusty conditions, or for other reasons, more positive feathering is required, a bar-stop 17b may be activated by pushing it towards the blade portion 16. This limits the turning angle f of the blade portion 16 to approximately 85°, between a perpendicular position for the power stroke and a position approximately 5° from horizontal during the return stroke, when the blade portion 16 is forced to plane, thereby effectively feathering.

Figure 8:
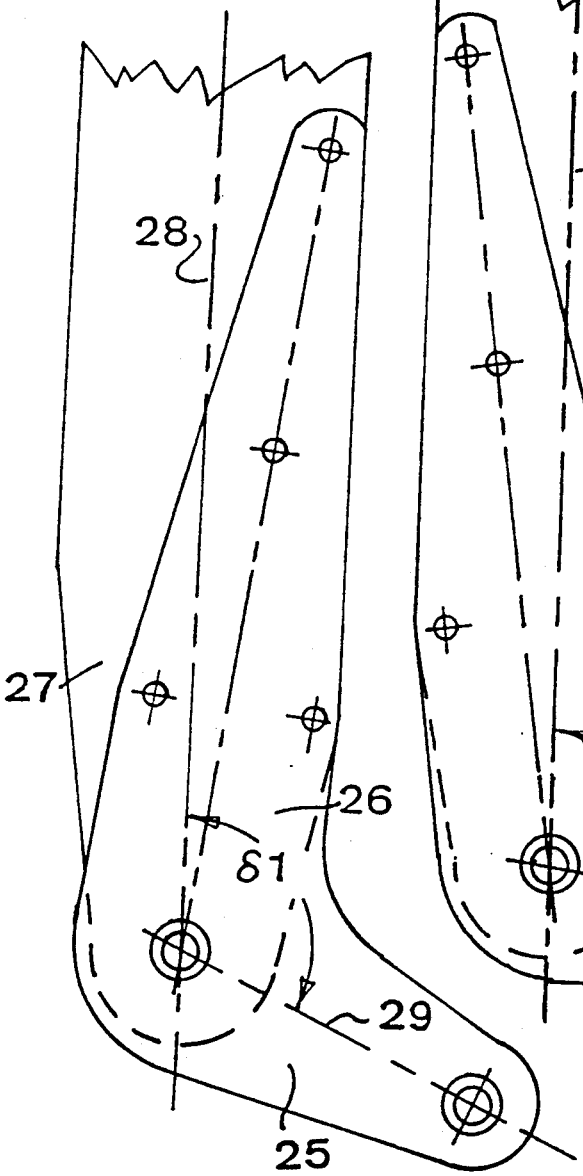
FIGS. 8 and 9 illustrate one method of providing for simple adjustment of the acceleration ratio.
Figure 9:
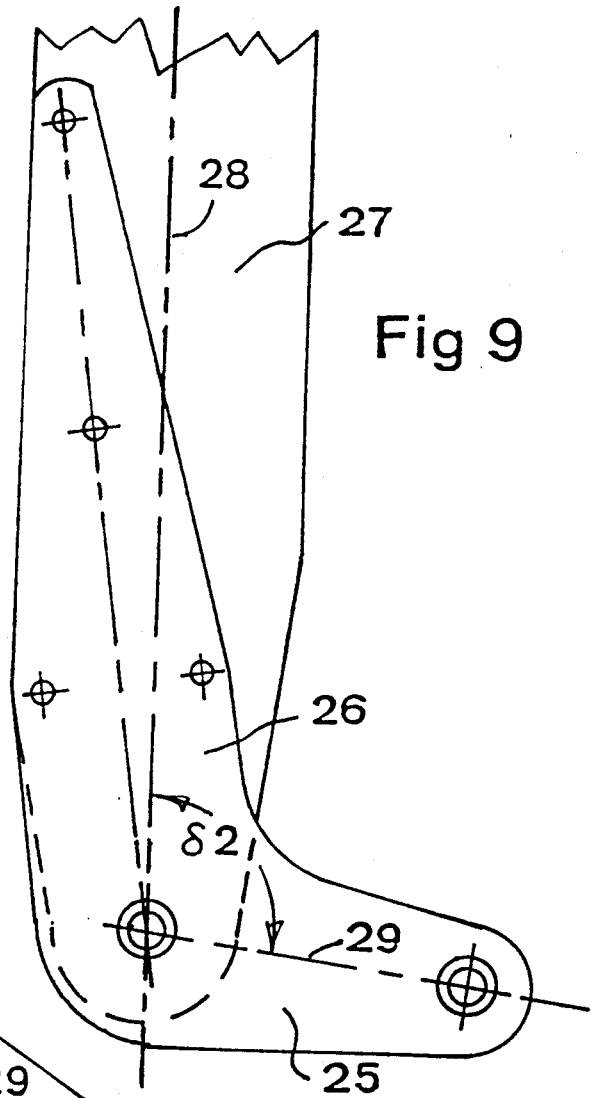

Turning next to FIGS. 8 and 9, these show a simple and effective manner of effecting a significant alteration of the angle of one of the crank arms relative to the axis of the associated oar blade or handle.

The crank arm 25 is formed as a part of a plate 26 which is bolted to the associated oar blade or handle 27, the oar blade or handle 27 being formed with a plurality of apertures to receive the fixing bolts and the plate 26 being formed with a correspondingly arranged array of apertures. The arrangement is such that the oar handle or blade 27 can be attached to the plate 26 either in a first position, as shown in FIG. 8, or in a second position, as shown in FIG. 9, the oar blade or handle 27 being turned through 180° about its axis 28 to change from the first position to the second position.

As can be seen, when the oar blade or handle 27 is in its first position, the crank angle, i.e. the angle between the axis 29 of the crank arm 25 and the axis 28 of the oar blade or handle 27 is a value $\delta 1$ whereas, in the second position, the crank angle will be a significantly smaller angle $\delta 2$. Thus change in the crank angle will produce a significant change in the acceleration ratio. It will, therefore, be apparent that, if the crank plates on the handles are constructed with different angles from those used on the blade stems, exchanging them will serve to make available further changes in acceleration ratio. This is, in fact, a complete alternative to the variations achieved in FIG. 4, and eight variations are again available.

FIG. 2 shows one way in which the angular movements of the oar blade 3 may be related to the angular movements of the oar handle 1, i.e. for six successive angular movements of 10° for the oar handle 1, the oar blade moves through 10°, 10½°, 11°, 13°, 16° and 20°. There is thus a steady increase of the relative blade velocity, i.e. of the velocity of the blade 3 relative to the handle 1, throughout the whole of the normal 60° movement of the handle 1 which constitutes a notional power stroke.

This means that, if the oar handle 1 is moved at a constant angular velocity, the oar blade 3 will be moved at a steadily increasing angular velocity, i.e. that the blade 3 will be caused to accelerate throughout the power stroke, the acceleration ratio in this case being 2. Appropriate adjustment of the relative lengths of the connecting link and the lever arms enables this acceleration ratio to be adjusted as required while maintaining a relationship in which the relative blade velocity increases throughout the power stroke.

This steady increase in the relative blade velocity ensures that an efficient rowing action is obtained. If, therefore, the oar handle is moved at a constant rate throughout the power stroke, which should be the case for a proficient rower, the oar blade will accelerate throughout the power stroke and will achieve its maximum velocity at the end of the power stroke.

The embodiments of the invention in which an exclusive property or privilege is claimed are defined as follows:

1. A forward facing rowing arrangement for a boat which includes an oar handle and an oar blade interconnected by a lever/linkage system which is so arranged that the angular velocity of the blade increases throughout a power stroke when the angular velocity of the handle is maintained at a steady rate, and in which means are provided whereby the acceleration ratio by the oar blade, when quantified against the oar handle's travel through a notional 60° arc comprising six equal increments of 10°, and reported in terms of the blade's angular travel during the last increment of movement of the handle divided by the blade's angular travel during the first increment of movement of the handle, can be set within the range of from 1 to at least 3.

2. A rowing arrangement according to claim 1, in which said acceleration ratio is adjustable.

3. A forward facing rowing arrangement for a boat which includes an oar handle and an oar blade interconnected by a lever/linkage system which is so arranged that the angular velocity of the blade increases throughout a power stroke when the angular velocity of the handle is maintained at a steady rate, and in which the lever/linkage system comprises lever arms rigidly attached to the oar handle and to the oar blade, said lever arms being in the form of cranks which are inclined relative to the axes of the oar handle and the oar blade respectively, and a link interconnecting the free ends of the lever arms.

4. A rowing arrangement according to claim 3, in which the lever arms are of substantially equal length and the link interconnecting the lever arms has a length at least equal to twice that of one of said lever arms.

5. A rowing arrangement according to claim 3, in which each oar blade is spoon-shaped, having a concave surface, and is supported on low friction bushes, the blade having a centre of gravity offset from the centre line of the oar such that, when the blade is in the air, the concave surface faces upwards and, when the blade is submerged, the concave surface faces the direction of blade travel through the water.

6. A rowing arrangement according to claim 5, in which the blade is provided with a stop movable into an operative position in which it acts to ensure that, during a return stroke, the blade adopts a position in which it is angled to the water surface such that the blade planes on the water.

7. A boat having a front-facing rowing arrangement which comprises a pair of oars each of which includes an oar handle, an oar blade and a supporting member hingedly mounted for movement relative to the boat about a generally horizontal axis, the oar handle and the oar blade of each oar being pivotally mounted on the associated supporting member for pivotal movement relative thereto about spaced generally vertical axes, the adjacent ends of each oar handle and blade comprising fixed crank arms which function as levers and have a substantially equal length, and a link interconnecting the free ends of the crank arms of each oar, each link having a length at least equal to twice the length of the associated crank arms and a lever system is afforded by each link and its associated crank arms being such that, during rowing, the angular velocity of each blade increases throughout a power stroke when the angular velocity of the handle is maintained at a steady rate.

8. A boat having a front-facing oar arrangement comprising a pair of oars each of which includes an oar handle, an oar blade and a supporting member hingedly mounted for movement relative to the boat about a generally horizontal axis extending generally parallel to the intended direction of travel of the boat, the oar handle and the oar blade of each oar being pivotally mounted on the associated supporting member for pivotal movement relative thereto about spaced parallel axes, each oar blade being connected to its respective oar handle by a lever/linkage system such that, if the handle is moved at a uniform rate, the blade will accelerate relative to the handle throughout the power stroke and in which the lever/linkage system is such that the acceleration ratio by the oar blade, when quantified against the oar handle's travel through a notional 60° arc comprising six equal increments of 10°, and reported in terms of the blade's angular travel during the last increment of movement of the handle divided by the blade's angular travel during the first increment of movement of the handle, can be set within the range of from 1 to at least 3.

9. A boat according to claim 8, in which the lever/-linkage system comprises lever arms rigidly attached to the oar handle and to the oar blade, said lever arms being in the form of cranks which are inclined relative to the axes of the oar handle and blade respectively, and a link interconnecting the free ends of the lever arms, the lever arms associated with the oar blades being in the form of plates which are alternatively connectible to the oar blades, providing one acceleration ratio in a first position and another acceleration ratio in a second position.

10. A boat according to claim 8, in which the lever/-linkage system comprises lever arms rigidly attached to the oar handle and to the oar blade, said lever arms being in the form of cranks which are inclined relative to the axes of the oar handle and blade respectively, and a link interconnecting the free ends of the lever arms, the lever arms associated with the oar handles being in the form of plates which are alternatively connectible to the oar handles, providing one acceleration ratio in a first position and another acceleration ratio in a second position.

* * * * *